US009377266B2

(12) United States Patent
Derus

(10) Patent No.: US 9,377,266 B2
(45) Date of Patent: Jun. 28, 2016

(54) RISER FOR A BOW

(71) Applicant: Perfect Form Manufacturing LLC, Wilmington, DE (US)

(72) Inventor: Michael W. Derus, Victor, NY (US)

(73) Assignee: Perfect Form Manufacturing LLC, West Henrietta, NY (US)

( * ) Notice: Subject to any disclaimer, the term of this patent is extended or adjusted under 35 U.S.C. 154(b) by 0 days.

(21) Appl. No.: 14/492,396

(22) Filed: Sep. 22, 2014

(65) Prior Publication Data

US 2015/0083098 A1 Mar. 26, 2015

Related U.S. Application Data

(60) Provisional application No. 61/880,303, filed on Sep. 20, 2013.

(51) Int. Cl.
*F41B 5/00* (2006.01)
*F41B 5/14* (2006.01)
*F41B 5/10* (2006.01)

(52) U.S. Cl.
CPC ..... *F41B 5/0031* (2013.01); *F41B 5/0078* (2013.01); *F41B 5/10* (2013.01); *F41B 5/14* (2013.01)

(58) Field of Classification Search
CPC ..... F41B 5/0031; F41B 5/10; F41B 5/14
USPC ..... 124/23.1, 25.6, 86, 88
See application file for complete search history.

(56) References Cited

U.S. PATENT DOCUMENTS 1,689,141 A * 10/1928 Keller ..... F41B 5/0094 124/22
1,847,593 A * 3/1932 Cameron ..... F41G 1/467 124/24.1
2,186,386 A * 1/1940 Lowell ..... F41B 5/143 124/24.1
2,909,167 A * 10/1959 Fredrickson ..... F41B 5/14 124/24.1
3,055,353 A * 9/1962 Perrucci ..... F41B 5/0005 124/24.1
3,923,036 A * 12/1975 Jennings ..... F41B 5/10 124/24.1
4,257,385 A * 3/1981 Stewart ..... F41G 1/467 124/24.1
4,343,286 A * 8/1982 Thacker ..... F41B 5/00 124/24.1
4,458,657 A * 7/1984 Stockmar ..... F41B 5/0094 124/17
4,759,337 A * 7/1988 Suski ..... F41B 5/14 124/24.1
4,971,020 A * 11/1990 Soderstrom ..... F41B 5/10 124/23.1
5,099,819 A * 3/1992 Simonds ..... F41B 5/10 124/23.1
5,649,519 A * 7/1997 Linderman ..... F41B 5/0005 124/23.1
5,682,871 A * 11/1997 Walk ..... F41B 5/10 124/24.1
6,019,097 A * 2/2000 Cox ..... F41B 5/0026 124/23.1
6,142,133 A * 11/2000 Anderson ..... F41B 5/10 124/24.1
6,758,204 B1 * 7/2004 Goff ..... F41B 5/10 124/25.6

(Continued)

*Primary Examiner* — Alexander Niconovich
(74) *Attorney, Agent, or Firm* — Barclay Damon, LLP

(57) ABSTRACT

A riser for a bow is disclosed. The riser includes a top riser section that is joined to a middle riser section by a first and second step. The first and second steps strengthen the riser and permit the riser to be formed from less material while resisting undesirable deformation during use.

23 Claims, 8 Drawing Sheets

(56) References Cited

U.S. PATENT DOCUMENTS 7,066,165 B2 * 6/2006 Perry ..... F41B 5/0005 124/23.1
7,258,113 B2 8/2007 Pilpel et al.
7,373,934 B2 * 5/2008 Smith ..... F41B 5/10 124/25.6
8,079,353 B2 * 12/2011 Davis ..... F41B 5/0026 124/23.1
8,522,762 B2 * 9/2013 Trpkovski ..... F41B 5/0094 124/23.1
8,622,050 B2 * 1/2014 Goff ..... F41B 5/12 124/25
8,627,810 B2 * 1/2014 McPherson ..... F41B 5/10 124/23.1
8,807,125 B1 * 8/2014 Mathur ..... B29C 45/0005 124/23.1
8,844,510 B2 * 9/2014 Liu ..... F41B 5/10 124/23.1
2007/0084451 A1 * 4/2007 Perry ..... F41B 5/14 124/23.1
2007/0101980 A1 * 5/2007 Sims ..... F41B 5/10 124/25.6
2010/0000504 A1 * 1/2010 Trpkovski ..... F41B 5/0094 124/25.6
2014/0261354 A1 * 9/2014 Ross, Jr. ..... F41B 5/143 124/23.1
2014/0366858 A1 * 12/2014 Garver ..... F41B 5/1403 124/25.6
2015/0153131 A1 * 6/2015 Trpkovski ..... F41B 5/0031 124/25.6

* cited by examiner

RISER FOR A BOW

CROSS-REFERENCE TO RELATED APPLICATIONS

This application is a non-provisional of U.S. patent application Ser. No. 61/880,303 (filed Sep. 20, 2013) the entirety of which is incorporated herein by reference.

BACKGROUND OF THE INVENTION

The subject matter disclosed herein relates to archery bows and more particularly to risers for bows. Archery risers are the central portion of a bow that provide a means for attachment of other bow components such as limbs, grips, sights, etc. During a bow's draw cycle, the riser is placed under extreme stress which often produces riser deformation. Excessive deformation of the riser can hinder repeatability, accuracy, promote riser fatigue, decrease safety and negatively impact other parameters of the bow. An improved archery riser is therefore desirable. The discussion above is merely provided for general background information and is not intended to be used as an aid in determining the scope of the claimed subject matter.

BRIEF DESCRIPTION OF THE INVENTION

A riser for a bow is disclosed. The riser includes a top riser section that is joined to a middle riser section by a first and second step. The first and second steps strengthen the riser and permit the riser to be formed from less material while resisting undesirable deformation during use. An advantage that may be realized in the practice of some disclosed embodiments of the ability to produce a riser for a bow that uses less material than other risers while maintaining a riser that resists undesirable deformation.

In a first embodiment, a riser for a bow is provided. The riser comprises a top riser section joined to a middle riser section. The top riser section defines a first plane and the middle riser section defines a second plane. The first plane and the second plane are spaced from one another by a gap to provide an arrow shelf. The top riser section is joined to the middle riser section by both a first top step and a second top step. The first top step and the second top step join together at a first junction, separate from one another to form a cavity, then reunite at a second junction. The first junction is in the first plane and connects to the top riser section and the second junction is in the second plane and connects to the middle riser section.

In a second embodiment, a riser for a bow is provided. The riser comprises a top riser section joined to a bottom riser section by a middle riser section. The top riser section and the bottom riser section are aligned to define a first plane and the middle riser section defines a second plane. The first plane and the second plane are spaced from one another by a gap to provide an arrow shelf. The bottom riser section is joined to the middle riser section by a bottom step and the top riser section is joined to the middle riser section by both a first top step and a second top step. The first top step and the second top step join together at a first junction, separate from one another to form a cavity, then reunite at a second junction. The first junction is in the first plane and connects to the top riser section. The second junction being in the second plane and connects to the middle riser section.

In a third embodiment, a bow is provided. The bow comprises a riser comprising a top riser section joined to a bottom riser section by a middle riser section. The top riser section and the bottom riser section are aligned to define a first plane and the middle riser section defines a second plane. The first plane and the second plane are spaced from one another by a gap to provide an arrow shelf. The bottom riser section is joined to the middle riser section by a bottom step and the top riser section is joined to the middle riser section by both a first top step and a second top step. The first top step and the second top step join together at a first junction, separate from one another to form a cavity, then reunite at a second junction. The first junction is in the first plane and connects to the top riser section and the second junction is in the second plane and connects to the middle riser section. The bow further comprises a first bow limb removably attached to the top riser section and a second bow limb removably attached to the bottom riser section.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

Figure 1A:
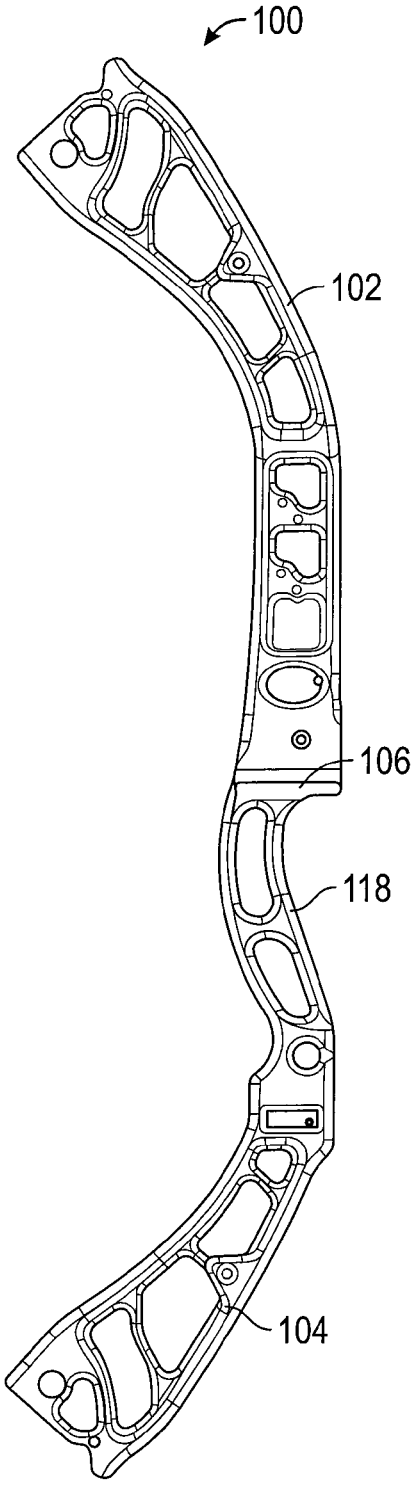
FIG. 1A, FIG. 1B and FIG. 1C are side, front and perspective views of an exemplary riser.
Figure 1B:
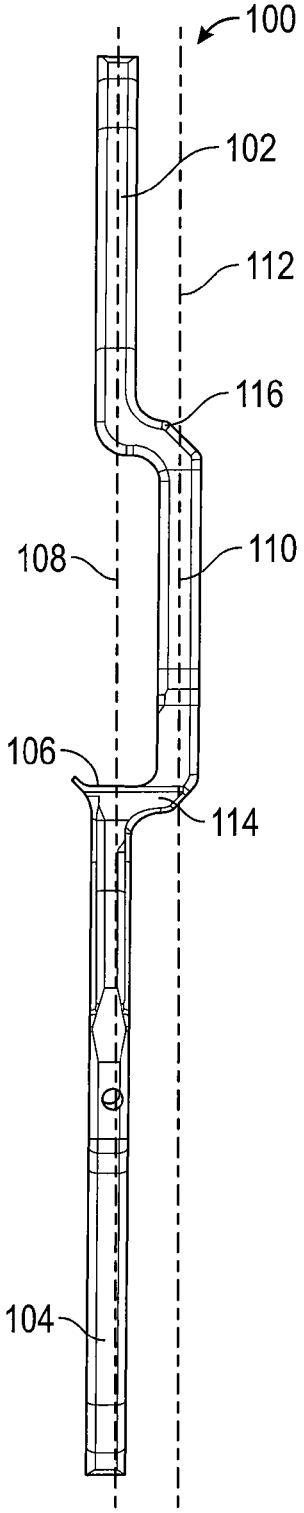
Figure 1C:
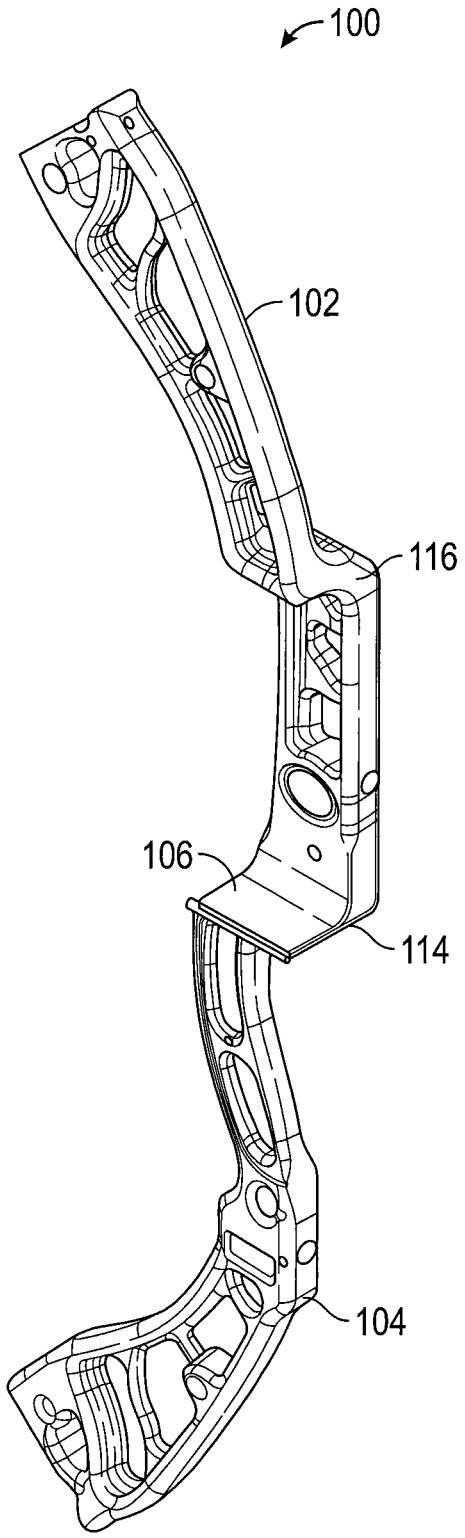

FIG. 1A, FIG. 1B and FIG. 1C depict a riser 100 that comprises a top riser section 102 and a bottom riser section 104. The top riser section 104 and the bottom riser section 104 define a first plane 108. Bow limbs (see FIG. 6) may be attached to the top riser section 102 and the bottom riser section 104, respectively. An arrow shelf 106 is provided by a middle riser section 110 that defines a second plane 112. The first plane 108 and the second plane 112 are separated by a gap. The middle riser section 110 joins with the bottom riser section 104 at a bottom step 114. The middle riser section 110 joins with the top riser section 102 at a top step 116. A handle 118 is provided below the arrow shelf 106 for an archery to grip the riser 100. During use, the top riser section 102 experiences stresses that causes undesirable deformations. To compensate for such deformations, the riser section 102 may be formed from strong, heavy materials. Unfortunately, this increases both the cost and the weight of the riser 100.

Figure 2A:
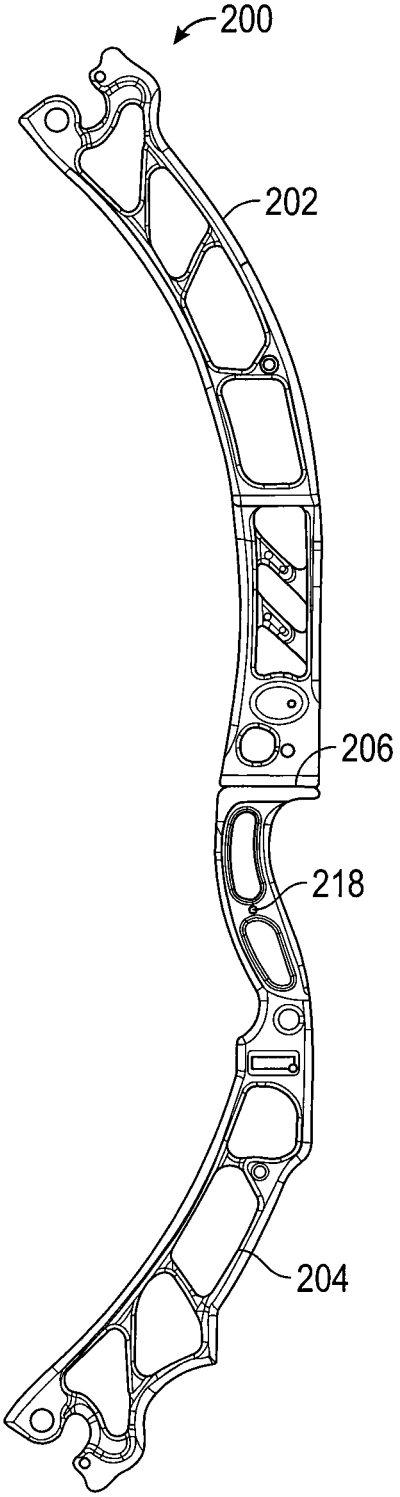
FIG. 2A, FIG. 2B and FIG. 2C are side, front and perspective views of another exemplary riser that includes a second step.
Figure 2B:
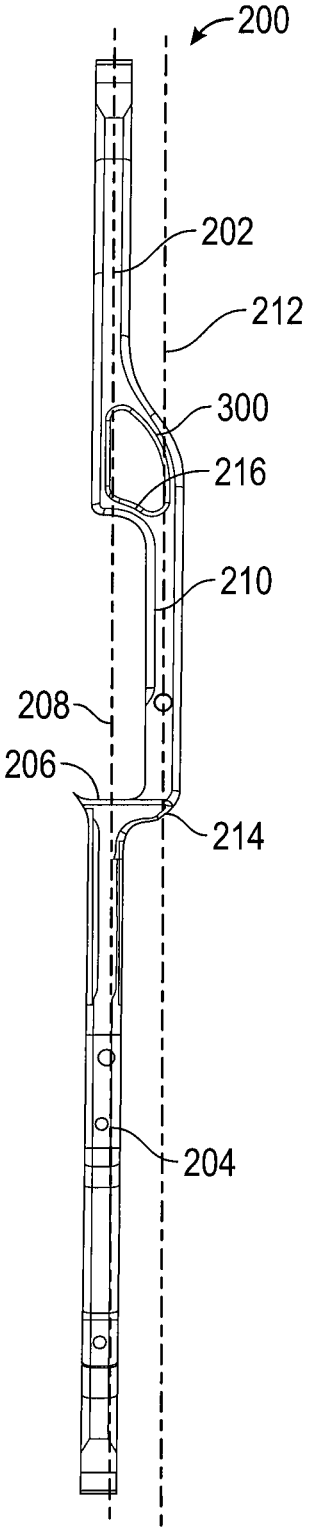
Figure 2C:
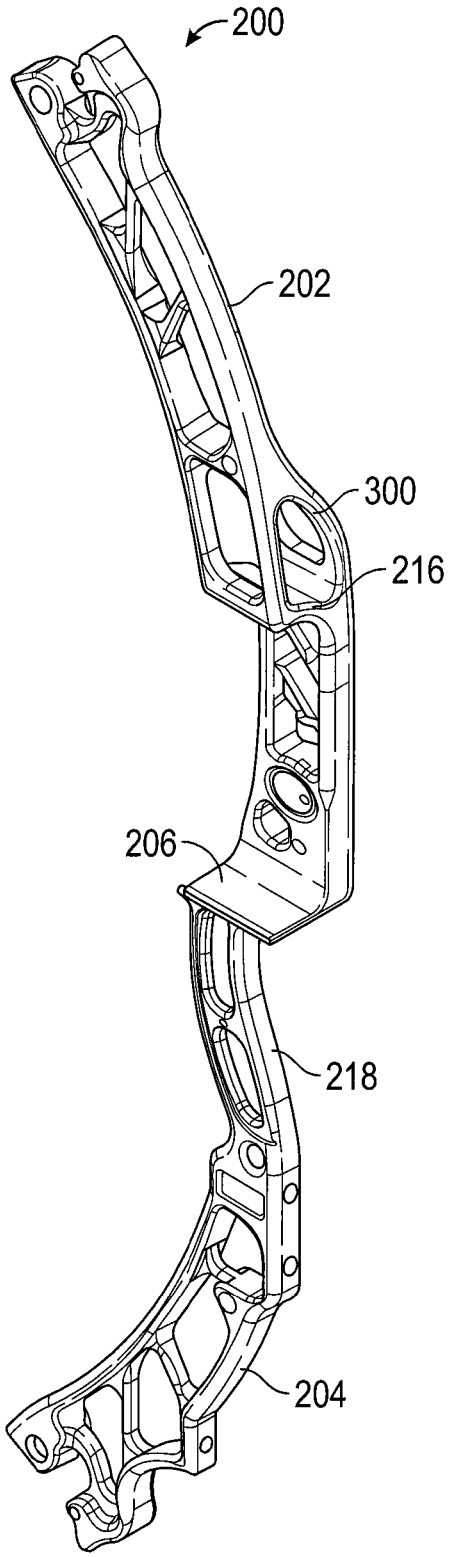

FIG. 2A, FIG. 2B and FIG. 2C depict a riser 200 that comprises a top riser section 202 and a bottom riser section 204. The top riser section 204 and the bottom riser section 204 define a first plane 208. An arrow shelf 206 is provided by a middle riser section 210 that defines a second plane 212. The first plane 208 and the second plane 212 are separated by a gap. The middle riser section 210 joins with the bottom riser section 204 at a bottom step 214. The middle riser section 110 joins with the top riser section 202 at a first top step 216. A handle 218 is provided below the arrow shelf 206 for an archer to grip the riser 200. Unlike the riser 100, the riser 200 further comprises a second top step 300. The configuration shown in FIG. 2A, FIG. 2B and FIG. 2C improves riser strength by as much as 30% and reduces deformation by as much as 20% compared to a riser without such a second top step 300. Due to the increased strength provided by the second top step 300, the riser may be formed using less material. This reduces the weight and cost of the riser without negatively impacting its performance.

Figure 3:
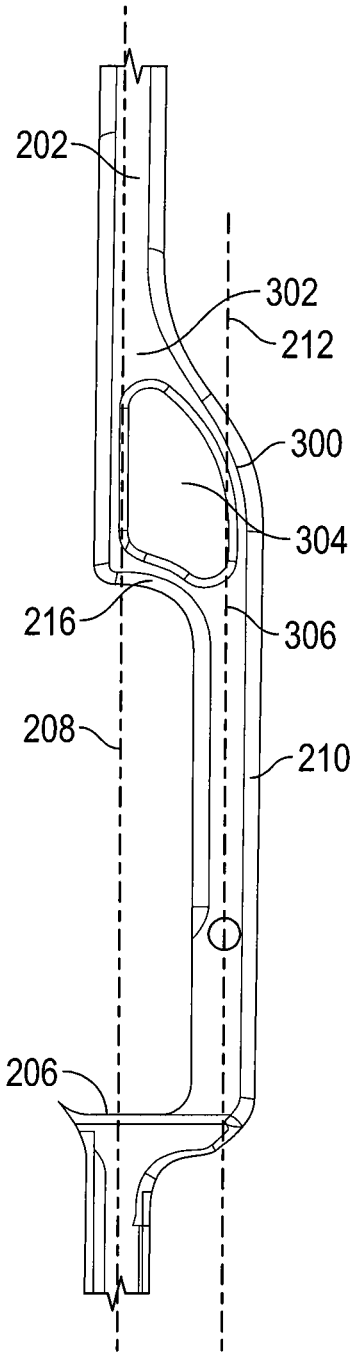
FIG. 3 is an expanded view of a section of the riser of FIG. 2B.

As shown in FIG. 3, the first top step 216 and the second top step 300 join at a first junction 302 where they both contact the top riser section 202. The first top step 216 and the second top step 300 separate to form a cavity 304 and then reunite at a second junction 306 where they both contact the middle riser section 210. The cavity 304 and the second top step 300 provide additional strength to the riser 200 while minimizing the amount of material used. This results in a reduction in weight and manufacturing costs. The first junction 302 is in the first plane 208 while the second junction 306 is in the second plane 212. The first top step 216 is disposed below the second top step 300.

Figure 4:
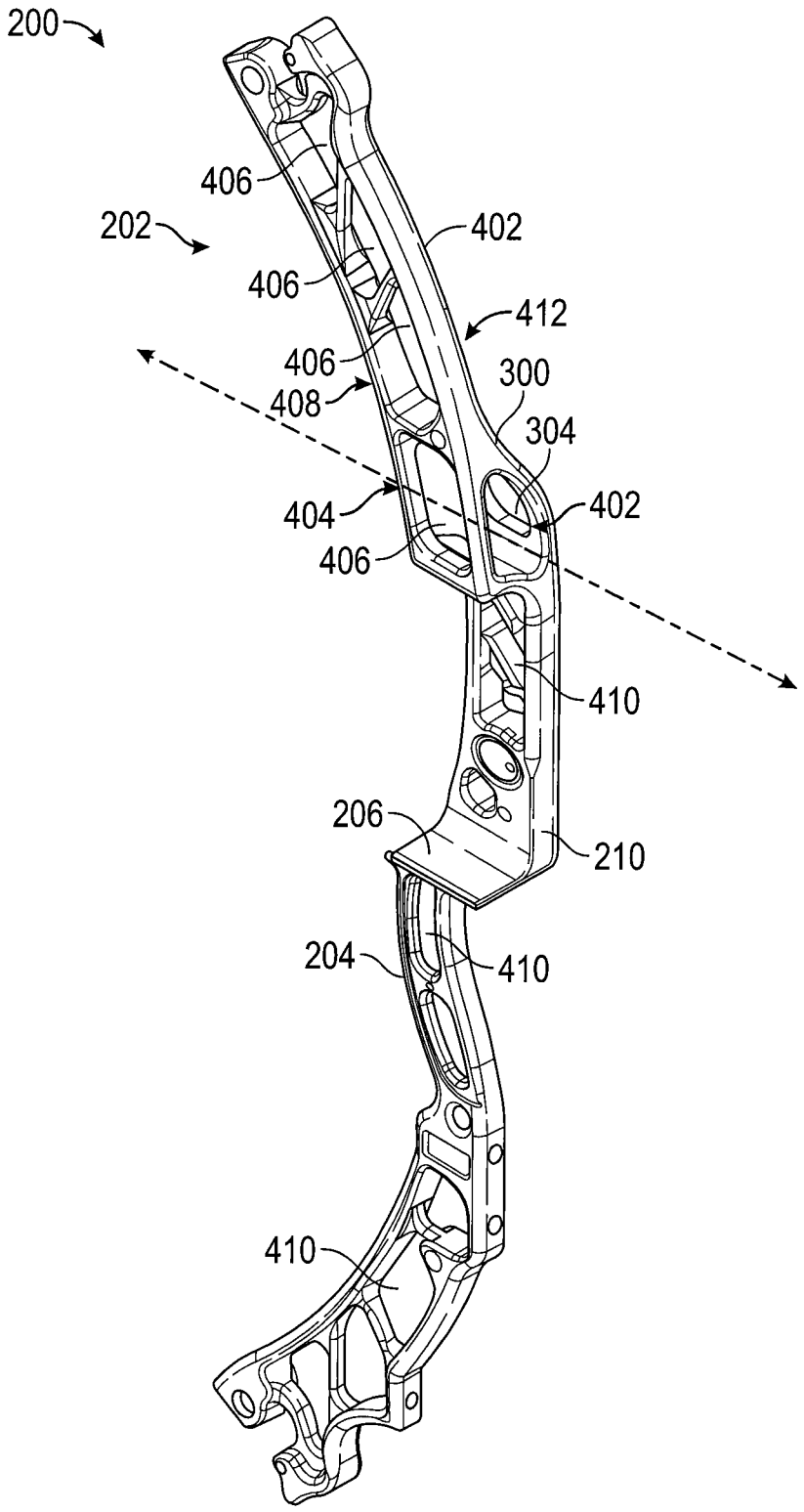
FIG. 4 is an expanded view of the riser of FIG. 2C.

As shown in FIG. 4, the cavity 304 comprises a forward-facing opening 402 and a backward-facing opening 404 that define a direction 404 that is parallel to a plane defined by the arrow shelf 206. The top riser section 202 comprises a plurality of holes 406 that extend from a first lateral side 408 to a second lateral side 412. The plurality of holes 406 are perpendicular to the forward-facing opening 402 and the backward-facing opening 404. The presence of the plurality of holes 406 permits the riser 200 to be formed using less materials, thereby reducing the weight and cost of the riser 200. The presence of the second top step 300 increases the strength of the riser 200 to minimize undesired deformation. Additional holes 410 in the lower riser section 204 and the middle riser section 210 further reduce the weight and cost of the riser 200. In the embodiment of FIG. 4, the cavity 304 comprises four openings: the forward-facing opening 402, the backward-facing opening 404, and two openings facing the lateral sides 408, 412, respectively. In another embodiment, not shown, the cavity 304 comprises at least one lateral facing opening and the forward-facing and backward-facing sides are solid plates.

Figure 5:
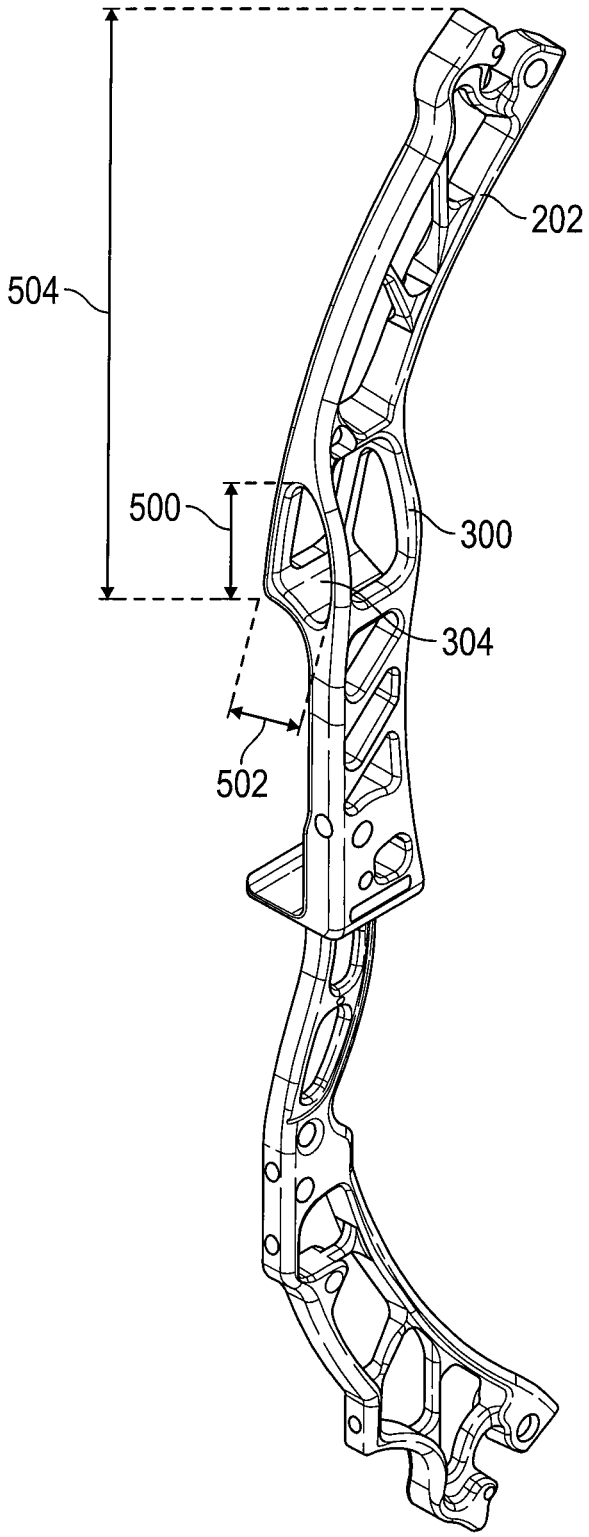
FIG. 5 is another view of the riser of FIG. 4.

As shown in FIG. 5, the cavity 304 has a length 500 and a width 502. In one embodiment, the length 500 is at least about 10% of an overall length 504 of the top riser section 202. In another embodiment, the length 500 is at least about 15% of the overall length 504. In another embodiment, the length 500 is at least about 20% of the overall length 504. In yet another embodiment, the length 500 is about 25% of the over length 504. The width 502 is less than the length 500. In one embodiment, the width is about 50% of the length 500.

Figure 6:
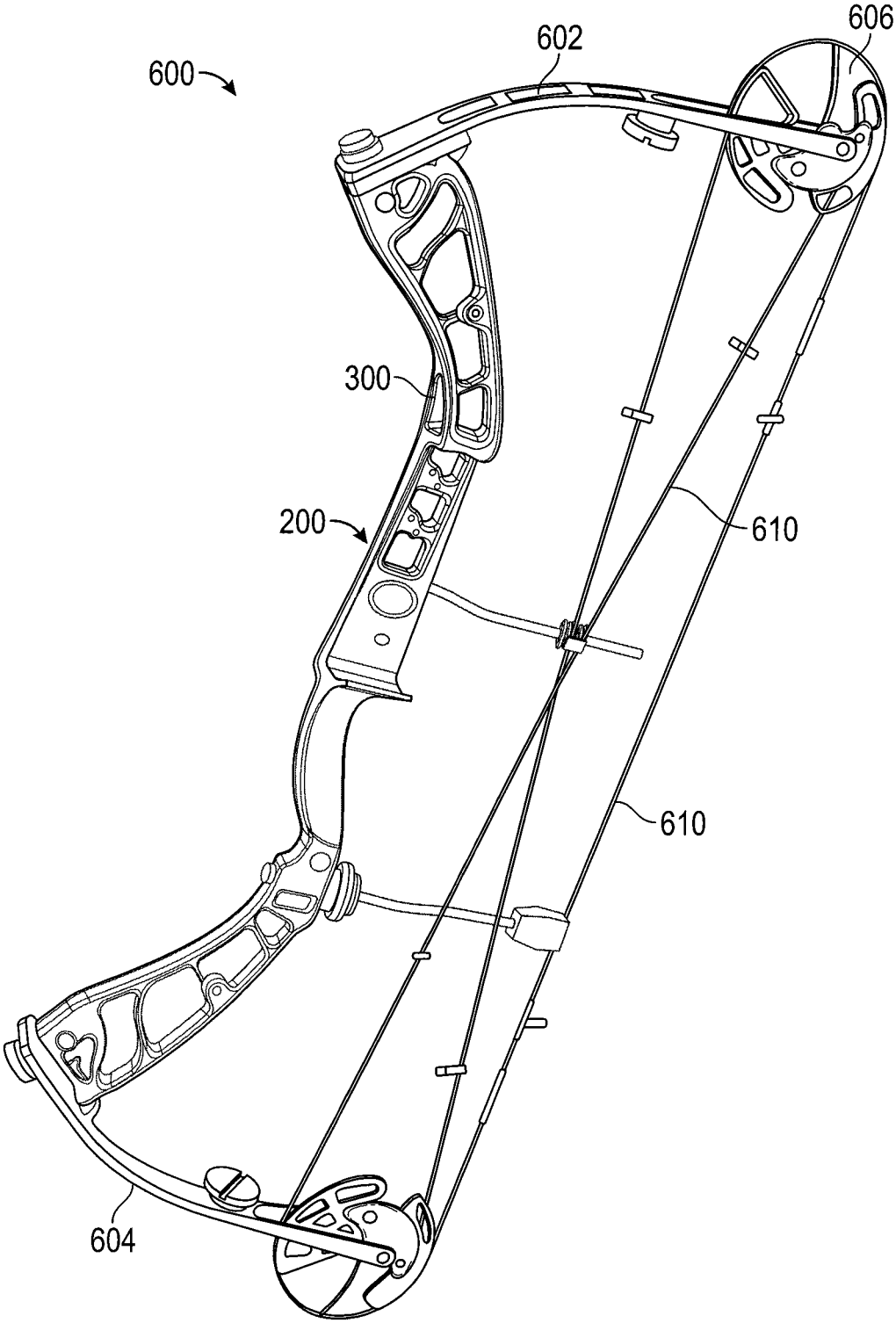
FIG. 6 is a view of an exemplary bow that uses the riser of FIG. 4.

FIG. 6 depicts a compound bow 600 that comprises the riser 200, a first bow limb 602 and a second bow limb 604. A first cam 606 and a second cam 608 are attached to the first bow limb 602 and the second bow limb 604, respectively. Bowstrings 610 are stretched between the first cam 606 and the second cam 608. When the bowstrings 610 are actuated, the first bow limb 602 and the second bow limb 604 bend and apply a strain to the riser 200. The second top step 300 (see FIG. 3) minimizes the deformation in the riser 200 caused by the strain. The presence of cams in the compound 600 permits a bowstring to be drawn with high force which results in significant strain on the riser 200. Accordingly, the riser 200 is particularly useful with compound bows.

In one embodiment, the riser is monolithic such that the top riser section, the bottom riser section and the middle riser section are formed as a single piece. The riser may be formed from a lightweight material, such as aluminum.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A riser for a bow, the riser comprising:

a top riser section having a riser center, the top riser section configured to be coupled to a limb, the limb configured to support a pulley so that the pulley applies a force which is transmitted to the riser center, the riser center being positioned on a vertical axis when the riser is vertically positioned;

a strengthening structure extending from the top riser section, the strengthening structure defining an interior space having a space center, the strengthening structure having a plurality of structure portions that surround the interior space, the structure portions including:

a structure front;

a structure back;

a structure top step;

a structure bottom step;

a first structure side configured to face in a first sideward direction, the first structure side extending in a first plane, the first plane extending parallel to the vertical axis, the space center being offset from the first plane; and a second structure side configured to face in a second sideward direction, the second structure side extending in a second plane spaced apart from the first plane; and a middle riser section extending from the strengthening structure, the middle riser section having a plurality of middle riser sides including a first middle riser side configured to face in the first sideward direction, the first middle riser side extending along the second plane, part of the middle riser section defining an arrow shelf.

2. The riser as recited in claim 1, wherein the top riser section is a single piece and the middle riser section is a single piece and wherein the top riser section splits to form the strengthening structure.

3. The riser as recited in claim 1, wherein the strengthening structure has a cage shape, and the interior space is unoccupied by any insertable component so as to avoid increasing a weight of the strengthening structure.

4. The riser as recited in claim 3, wherein each one of the structure sides defines an opening, each opening providing access to the interior space.

5. The riser as recited in claim 4, wherein the structure front defines a forward facing opening, and the structure back defines a backward-facing opening, each of which is positioned on an axis parallel to a shooting direction when the riser is vertically positioned.

6. The riser as recited in claim 5, wherein the first structure side defines a first lateral facing opening that faces in the first sideward direction, and a second one of the structure sides defines a second lateral-facing opening that faces in the second sideward direction opposite of the first sideward direction along an axis parallel to the first sideward direction.

7. The riser as recited in claim 1, wherein each of the middle riser section and the strengthening structure has a dimension extending along an axis that is transverse to a plane in which a shooting direction extends when the riser is held upright, the dimension of the strengthening structure being greater than the dimension of the middle riser section to reduce deformation of the top riser section.

8. The riser as recited in claim 1, wherein:

each of the structure back and the structure front defines a window, the windows being positioned on an axis parallel to a shooting direction when the riser is oriented upright; and the windows are configured to enable visibility to a target positioned in the shooting direction when the riser is vertically positioned.

9. A riser for a bow, the riser comprising:

a middle riser section having a first end, a second end, a front configured to face a target, a rear, a left side, a right side, and a first dimension between the right and left sides;

a first riser section having a riser center, the first riser section extending upward from the first end of the middle riser section when the riser is vertically positioned, the first riser section configured to be coupled to a limb so that the limb conveys a force to the riser center, the riser center being positioned on a vertical axis when the riser is vertically positioned, the first riser section having a structure, the structure being at least partially hollowed to bound an interior cavity having a cavity center, the structure having a structure front configured to face the target, a structure rear, a left structure side extending in a first plane, the first plane extending parallel to the vertical axis the cavity center being offset from the first plane, a right structure side, and a second dimension between the right and left structure sides, the second dimension being greater than the first dimension of the middle riser section; and a second riser section extending downward from the second end when the riser is vertically positioned, wherein the second dimension of the structure is configured to reduce deformation of the first riser section, and wherein hollowing of the structure reduces any weight increase caused by the second dimension of the structure.

10. The riser as recited in claim 9, wherein the first riser section and the middle riser section are elements of a single piece and wherein the first riser section splits to form the structure.

11. The riser as recited in claim 9, wherein:

each of the structure front and structure rear defines a window, the windows being positioned on an axis parallel to a shooting direction when the riser is oriented upright; and the windows are configured to provide visibility to a target positioned in the shooting direction when the riser is vertically positioned.

12. The riser as recited in claim 11, wherein the shooting direction extends in a plane and wherein each of the left and right structure sides defines a hole, the holes being positioned on an axis transverse to the plane.

13. The riser as recited in claim 12, wherein the riser has a unitary configuration wherein the first end of the middle riser section splits so as to transition to the structure of the first riser section.

14. The riser as recited in claim 9, wherein the structure comprises a cage configuration, and the interior cavity is unoccupied by any insertable device so as to avoid increasing a weight of the structure.

15. A bow comprising:

a first bow limb configured to support a pulley so that first bow limb receives a force from the pulley;

a first riser section having a riser center, the first riser section extending downward from the first bow limb when the bow is vertically positioned, wherein the riser center is configured to receive the force, the riser center being positioned on a vertical axis when the bow is vertically positioned, the first riser section having a structure, the structure being at least partially hollowed to bound an interior cavity having a cavity center, the structure having a structure front configured to face a target, a structure rear, a left structure side extending in a first plane, the first plane extending parallel to the vertical axis, a right structure side extending in a second plane, the cavity center positioned between the first plane and the second plane, and a second dimension between the right and left structure sides, the second dimension being greater than a first dimension of the middle riser section;

a middle riser section having a first end section extending downward from the first riser section when the bow is vertically positioned, a second end, a front configured to face the target, a rear, a left side, a right side, and the first dimension between the right and left sides;

a second riser section extending downward from the second end when the bow is vertically positioned;

and a second bow limb attached to the second riser section.

16. The bow as recited in claim 15, wherein the pulley comprises a first cam attached to the first bow limb, and the bow comprises a second cam attached to the second bow limb.

17. The bow as recited in claim 15, wherein the top riser section further comprises each of the left and right structure sides defining a plurality of holes that are positioned on an axis that is transverse to a plane in which a shooting direction extends when the bow is held upright.

18. The bow as recited in claim 15, wherein the middle riser section and the first riser section are sections of a unitary element, and the first riser section splits from the middle riser section to define the structure.

19. The bow as recited in claim 15, wherein the interior cavity is unoccupied by any insertable force transmitting element so as to avoid increasing a weight of the structure.

20. The bow of claim 15, wherein the second dimension of the structure is configured to reduce deformation of the first riser section.

21. The bow of claim 20, wherein hollowing of the structure reduces any weight increase caused by the second dimension of the structure.

22. The bow as recited in claim 15, wherein the first riser section and the middle riser section are constructed of a single piece and wherein the first riser section splits to form the structure.

23. The bow as recited in claim 15, wherein:

each of the structure front and structure rear defines a window, the windows being positioned on an axis parallel to a shooting direction when the bow is oriented upright; and the windows are configured to provide visibility to a target positioned in the shooting direction when the bow is vertically positioned.

* * * * *